US006701974B2

(12) United States Patent
Rudesill

(10) Patent No.: US 6,701,974 B2
(45) Date of Patent: Mar. 9, 2004

(54) AUTOMATED NUGGET DISPENSER

(75) Inventor: Brian R. Rudesill, Hudson, WI (US)

(73) Assignee: Base Design, Inc., Hudson, WI (US)

( * ) Notice: Subject to any disclaimer, the term of this patent is extended or adjusted under 35 U.S.C. 154(b) by 20 days.

(21) Appl. No.: 10/040,892

(22) Filed: Jan. 2, 2002

(65) Prior Publication Data

US 2003/0121933 A1 Jul. 3, 2003

(51) Int. Cl.[7] ..... B65B 1/04
(52) U.S. Cl. ..... 141/18; 222/555; 222/485
(58) Field of Search ..... 222/181.1, 185.1, 222/555, 429, 146.6, 485; 221/203, 265; 99/407; 141/2, 18, 98

(56) References Cited

U.S. PATENT DOCUMENTS

| | | | | |
|---|---|---|---|---|
| 1,165,907 A | | 12/1915 | Riddle | |
| 1,465,680 A | * | 8/1923 | Pappas et al. | 222/516 |
| 2,772,818 A | | 12/1956 | McLauchlan | |
| 2,863,590 A | | 12/1958 | Giesse | |
| 4,586,429 A | | 5/1986 | Hawkins | |
| 4,964,535 A | | 10/1990 | Curwen | |
| 5,052,288 A | | 10/1991 | Marquez et al. | |
| 5,104,002 A | | 4/1992 | Cahlander et al. | |
| 5,132,914 A | | 7/1992 | Cahlander et al. | |
| 5,172,328 A | | 12/1992 | Cahlander et al. | |
| 5,174,470 A | | 12/1992 | North et al. | |
| 5,191,918 A | | 3/1993 | Cahlander et al. | |
| 5,280,845 A | * | 1/1994 | Leight | 221/2 |
| 5,282,498 A | | 2/1994 | Cahlander et al. | |
| 5,353,847 A | | 10/1994 | Cahlander et al. | |
| 5,404,796 A | * | 4/1995 | Campbell et al. | 99/357 |
| 5,598,947 A | * | 2/1997 | Smith | 221/150 HC |
| 5,778,767 A | | 7/1998 | Rudesill | |
| 5,901,886 A | * | 5/1999 | Grindstaff et al. | 222/557 |

* cited by examiner

*Primary Examiner*—Steven O. Douglas
(74) *Attorney, Agent, or Firm*—Vidas, Arrett & Steinkraus, P.A.

(57) ABSTRACT

A dispensing machine for dispensing items from a storage container and into an object container is disclosed. The dispensing machine dispenses items such as frozen chicken nuggets or other food items which are normally cooked and sold by volume. Accordingly, the machine may be set to dispense a pre-selected portion of chicken nuggets from the input hopper. The object container is typically a deep-frying basket. Upon activating the machine, the user will not have to count the items nor will the user have to touch the items at any time, thereby reducing or eliminating opportunities for contamination of the items and consequent spread of disease or unpalatable impurities such as dirt. The machine may be fully automatic or may be hand operated. Where the items are edible items that must be refrigerated, the machine components may be contained in refrigeration unit. Access to the interior of the machine is provided through one or more doors which are designed to remain shut during operation of the machine.

21 Claims, 6 Drawing Sheets

AUTOMATED NUGGET DISPENSER

BACKGROUND OF THE INVENTION

1. Field of the Invention

This invention relates generally to the automated dispensing of items which may be items of any description. More specifically, this invention relates to automated dispensing of edible items, such as frozen, chicken nuggets or other frozen food items such as fruit, where the items being dispensed are sold or packaged by number, weight, or by volume. The machine may be set to dispense one of a number of pre-selected quantities of items. The machine has the additional benefit that it works without necessity for human contact with the items, a benefit highly desirable in food processing.

2. Discussion of the Related Art

Many machines exist for automatic dispensing of items. Candy, soda, and other vending machines have been around for countless years. The mechanisms employed to accomplish the dispensing vary widely. The vast majority of these machines simply dispense one item per use. A vending machine route person loads the machines with one item per compartment or otherwise performs the counting. Thus, the counting function depends on human interaction.

Counting machines of various descriptions also exist, but no machines are designed for counting and dispensing items for fast food restaurants. In the case of seed dispensing mechanisms used by farmers, for example, U.S. Pat. No. 6,283,051 to Yoss, the seed is cast upon the ground. In seed dispensing machines, one goal is for the seeds to be dispensed at some uniform rate as the farm machine passes over the ground. Clearly, it is undesirable for food items to be dispensed in this manner.

Another aspect of existing machines which renders the machines undesirable for food processing is that the machines usually distribute the items over a distance. As the wheels of the machine roll over the ground, a pre-selected number of seeds are dropped for given units of distance. For example, the machine may drop one seed every ten inches. These machines lack any considerations of prophylaxis. They are open and exposed to all manner of dirt, insects, vermin, weather, and other elements that make these machines unsuitable for use in human food processing.

Precooked frozen chicken meat poses special health considerations. Improper handling of precooked frozen chicken meat significantly increases the risk of contamination. Good health practices mandate that precooked frozen chicken be processed only on surfaces and with implements and containers, including refrigeration units, used solely for raw and/or precooked chicken meat. No known existing machine overcomes all of the problems in processing frozen precooked chicken meat prior to cooking for human consumption.

U.S. Pat. No. 5,778,767, issued Jul. 14, 1998 to Brian Rudesill, also inventor of the present invention, discloses a Dispenser Apparatus for dispensing a predetermined quantity of food items, such as frozen french fries. In the earlier Rudesill patent, the dispensing mechanism includes a rotatable drum. The french fries fall by gravity into the rotatable drum. As a slot in the drum passes over a slotted plate, permitting the french fries to fall into a waiting container.

The device in the earlier Rudesill patent does not count the number of french fries. Portion control is substantially accomplished by the rate of rotation of the rotatable drum and the sizes of the slots in the rotatable drum and the plate. Thus, in this earlier device, dispensing is by volume.

Fast-food restaurants are a fixture of our society. One of the popular menu items for these restaurants is chicken nuggets. These nuggets are normally sold by count. A portion consists of some set number of nuggets, for example, ten nuggets per serving. With the existing art, some person must count out the desired number of nuggets. When this is done at the restaurant, the time it takes to count out the number of nuggets adds to the time required to serve the customer.

If the counting is done prior to the customer's making the order, then there must be some packaging of the portion. The prior counting must be done at the restaurant or at some distribution facility. Packaging introduces a waste issue as well as a delay in opening the package. Having a distributor do the counting and packaging means increased prices to the restaurant. On-site prior counting adds the problem that there will be loss of refrigeration during the counting. If the items to be counted are perishable, then thawing can significantly increase risk of contamination. Handling of food items may increase risks of other hazards from contamination by flying insects to the risk of hairs from the person doing the counting dropping onto the food. All of these health issues are clearly undesirable.

Fast food restaurants, in order to maximize profitability, attempt to avoid waste of unsold cooked food items. In the past, it has been difficult to regulate and/or estimate the quantity or volume of a food article prior to, or during cooking. As a result, excess quantities of food may have been inadvertently cooked where the unused food in excess of consumer demand may have been required to be disposed of without sale. A need therefore exists to regulate different batch sizes of food articles to be cooked. At peak sales periods, a large batch of food articles may be desired for cooking while at off hours a relatively small quantity of food articles may be desired for cooking. It is anticipated that the disclosed invention will assist in dispensing large, medium, and small batches of food articles for cooking, thereby satisfying a particular need or demand for a restaurant.

BRIEF DESCRIPTION OF THE INVENTION

A dispensing machine for dispensing items from a storage container and into an object container is disclosed. The dispensing machine dispenses items such as frozen chicken nuggets or other food items which are normally cooked and sold by count, or volume. Accordingly, the machine may be set to dispense a pre-selected volume of chicken nuggets from the input hopper. The object container is typically a deep-frying basket. Upon activating the machine, the user will not have to count the items nor will the user have to touch the items at any time, thereby reducing or eliminating opportunities for contamination of the items and consequent spread of disease or unpalatable impurities such as dirt. The machine may be fully automatic or may be hand operated. Where the items are edible items that must be refrigerated, the machine components may be contained in refrigeration unit. Access to the interior of the machine is provided through one or more doors which are designed to remain shut during operation of the machine.

An advantage of the invention is that it has a storage container which may hold a large quantity of items to be dispensed.

Another advantage of the invention is that it has a rotatable plate which moves items to be dispensed into position for placement in the object container.

Still another advantage of the invention is the existence of a catch tray which accumulates excess crumbs or liquid.

Still another advantage of the invention is that the rotatable plate and the catch tray have openings sufficiently large for the items to fall through the plates, and which sizing permits a desired number of items to fall through, but which prevents more than the desired number of items from falling through the plates.

Still another advantage of the invention is that it has an object container positioned below the catch tray for containing the items that fall through the catch tray.

Still another advantage of the invention is that the storage container, rotatable plate, catch tray, and object container are contained within a frame or cabinet which locates the components and keeps the sanitary items sanitary.

Still another advantage of the invention is that the cabinet may be refrigerated to keep frozen food frozen.

Still another advantage of the invention is that the cabinet may have one or two doors in the side of the cabinet for access to the interior of the cabinet.

Still another advantage of the invention is that the catch tray also functions to support the hopper within the dispensing apparatus.

Still another advantage of the invention is that it has cabinet doors which may be hinged to the cabinet, may be fastened to the cabinet with fasteners.

Still another advantage of the invention is the control unit which permits the user to select the number of items to be dispensed.

Still another advantage of the invention it that it can dispense edible items, including frozen chicken nuggets, frozen fruit, or inedible items which gives the machine a wide range of uses.

Still another advantage of the invention is that it has a rotatable disk, which may be rotated manually, which gives the machine the ability to function away from an external power source.

Still another advantage of the invention is that it has a rotatable disk which may be rotated by a motor, which gives the machine the ability to function using an external power source.

Still another advantage of the invention is that it has a rotatable disk which may be rotated by chain, belt, or direct drive which provides the machine a variety of mechanical rotational mechanisms.

Still another advantage of the invention is that it has a control apparatus which may be a rotatable knob, an electromechanical device, an electronic device and/or a microprocessor which is adapted to provide a variety of methods for control of the quantity or volume of an article, thus giving the user a number of choices for how the machine regulates the quantity or volume of an article to be dispensed.

Still another advantage of the invention is that it has a control apparatus which regulates the number of degrees of rotation that the rotatable disk turns thus controlling the number of items which fall into the object container.

Still another advantage of the invention is that the object container may be a deep-frying basket for frying chicken nuggets.

Still another advantage of the invention is that the object container may be a bag into which items may be dispensed, so the items may be packaged for sale, storage, sanitation, or other purposes.

Still another advantage of the invention is that the storage container may be constructed of a hopper for storing items and a chute through which the items fall, where the chute may be positioned for directing the falling of items through openings in the rotatable plate.

Still another advantage of the invention is that the rotatable plate may turn about an axis of up to 65 degrees from the vertical in order to accommodate a wide variety of items which makes the dispenser more versatile.

DETAILED DESCRIPTION OF THE PREFERRED EMBODIMENTS

While this specification concludes with claims defining the features of the invention which are regarded as novel, it is believed that the invention will be better understood from a consideration of the following description in conjunction with the claims and drawing figures.

Dispensing, unless the context implies otherwise, shall mean portioning and containerizing.

Figure 1:
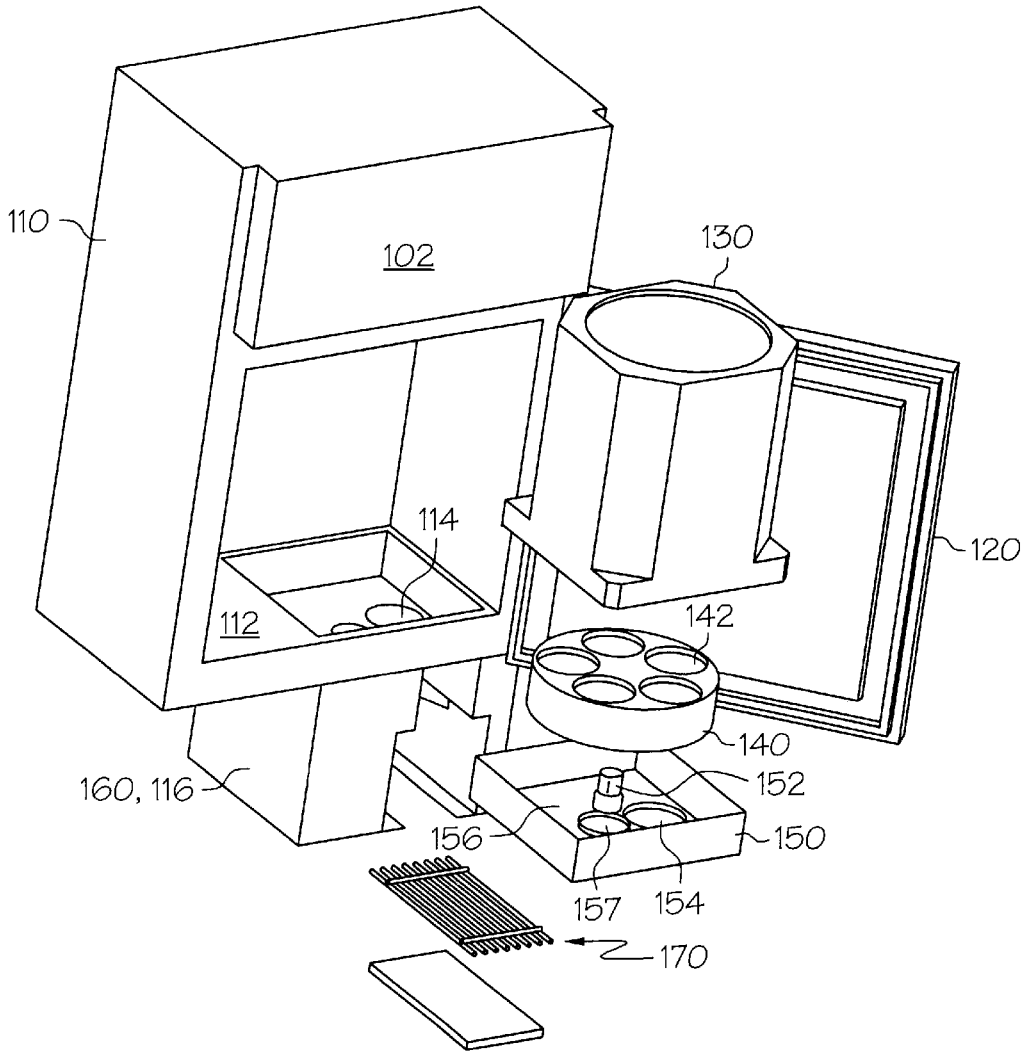
FIG. 1 shows an exploded view of major components of the machine.

The machine consists of two basic assemblies. The inner assembly, FIG. 1, parts 130, 140, 150, 170, and 180, consists of the mechanism for portioning and containerizing the food items. The outer assembly consists of a frame or cabinet, part 110 and control unit 160, which may entirely enclose the inner assembly or may, depending on the requirements of the user, be open. In one embodiment, the outer assembly is a cabinet 110 with one or more doors, 120, for access to the inner assembly. In the embodiment in which the cabinet 110 encloses a refrigeration unit 102, it is easy to envision that the doors are refrigerator doors.

Figure 2:
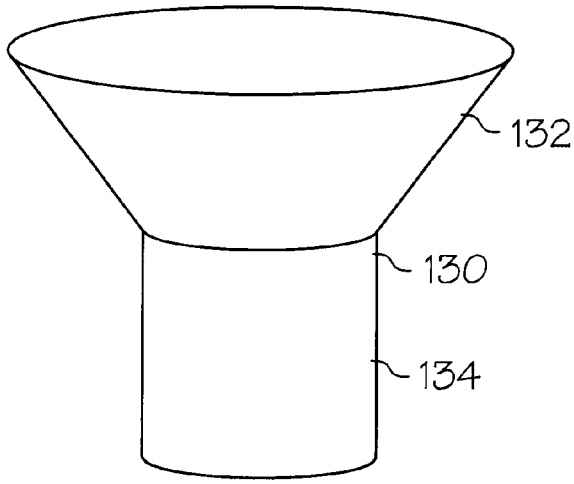
FIG. 2 shows an alternate embodiment of the hopper.

The storage component is referred to by numeral 130 into which items are loaded. This storage component 130 may be thought of as being a single unit, as in FIG. 1, or may include two sections, as in FIG. 2, having tapered hopper 132 and cylindrical chute 134. Generally, items fall by gravity through tapered hopper 132 and cylindrical chute 134. The hopper 132 and chute 134 may be shapes other than depicted in FIGS. 1 and 2. The hopper 132 and chute 134 may be so constructed as to align the items with the openings 142 in the rotatable plate 140. The unitary storage component 130 combines the functions of the hopper 132 and chute 134.

Figure 8:
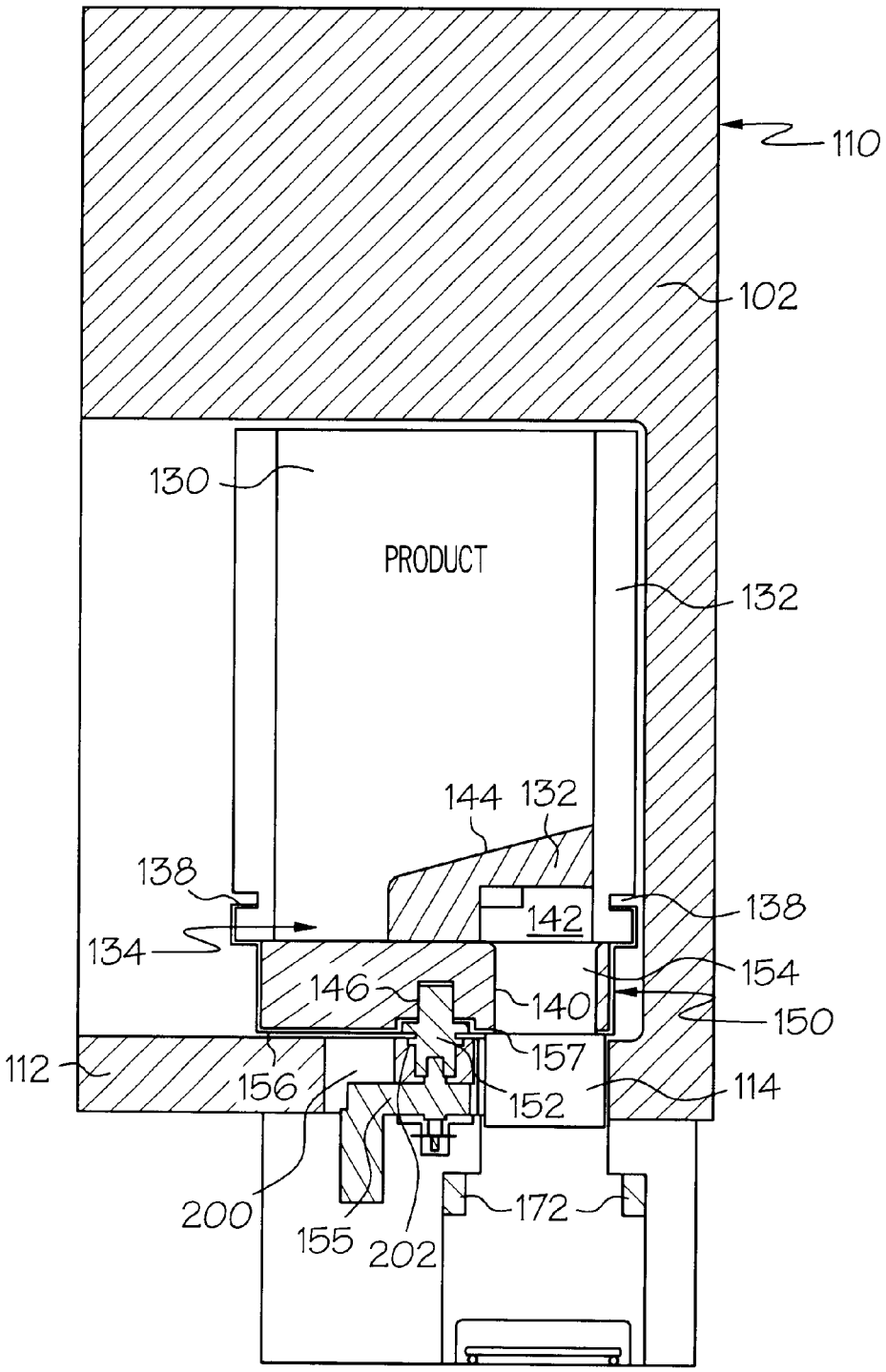
FIG. 8 is a cross-sectional side view of the machine taken along the line 8—8 of FIG. 6.

In an alternative embodiment as depicted in FIG. 8 the hopper 132 includes an angled deflector 144. The angled deflector 144 may have any angle of incline as desired to facilitate positioning of product within the chute 134 by gravity. The angled deflector 144 is preferably positioned above and covers the discharge openings 154 of the catch tray 150, so that openings 142 of rotatable plate 140 are filled from chute 134 opposite to opening 154. The base or bottom 156 of catch tray 150 thereby functions as a fill limiter for each opening 142 of rotatable plate 140.

Figure 3:
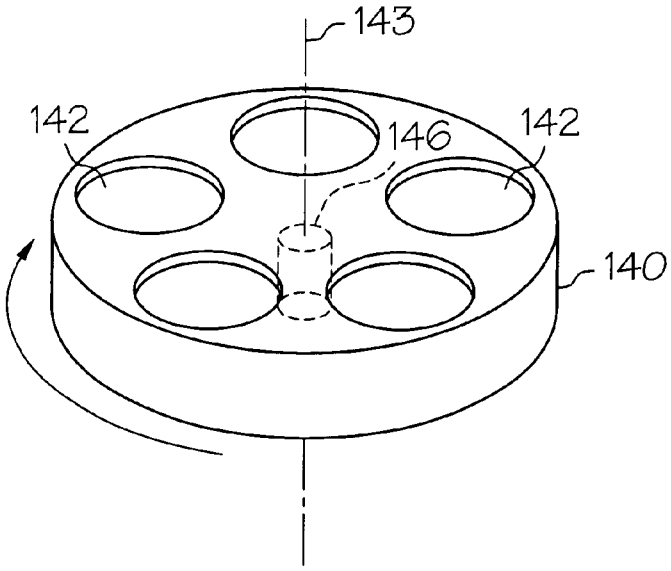
FIG. 3 shows the rotatable plate in more detail.

After falling through the storage component 130, items fall upon the rotatable plate 140, see FIG. 3. The rotatable plate 140 is perforated with one or more openings 142. The size and number of these openings 142 may be selected by the user from a range of plates 140. The opening size selected for openings 142 must be sufficiently large to permit the items to pass therethrough. The plates 140 may restrict the passage of one or more items through the plates 140 at any one time. In one embodiment each opening 142 may hold approximately ten frozen chicken nuggets.

The rotatable plate 140 rotates about a central axis 143 which may be substantially vertical although specific needs of the user may be served by having the axis of rotation 143 other than vertical. The range of axes may vary from vertical to as much as 65 degrees from vertical. The rotatable plate 140 is shown circular but may be any shape consistent with the function of the machine or needs of the user. As maybe seen in FIGS. 1, 7, and 8 rotatable plate 140 is preferably positioned within catch tray 150. Rotatable plate 140 is preferably sized for free rotation within interior of catch tray 150. Each opening 142 of rotatable plate 140 holds a set volume of items to be dispensed.

Figure 4:
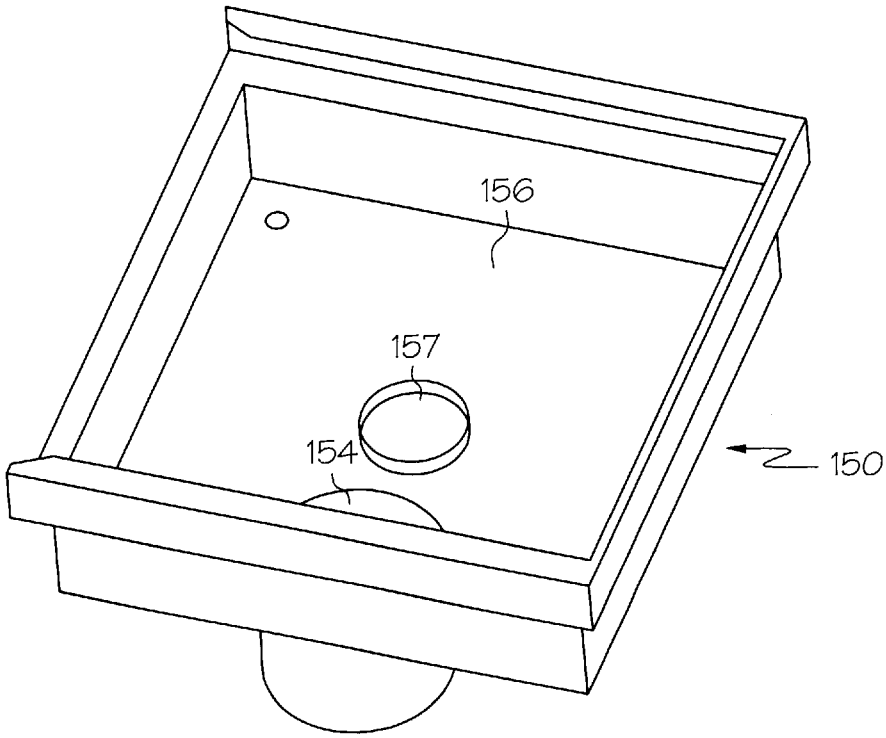
FIG. 4 shows the catch tray in more detail.
Figure 5:
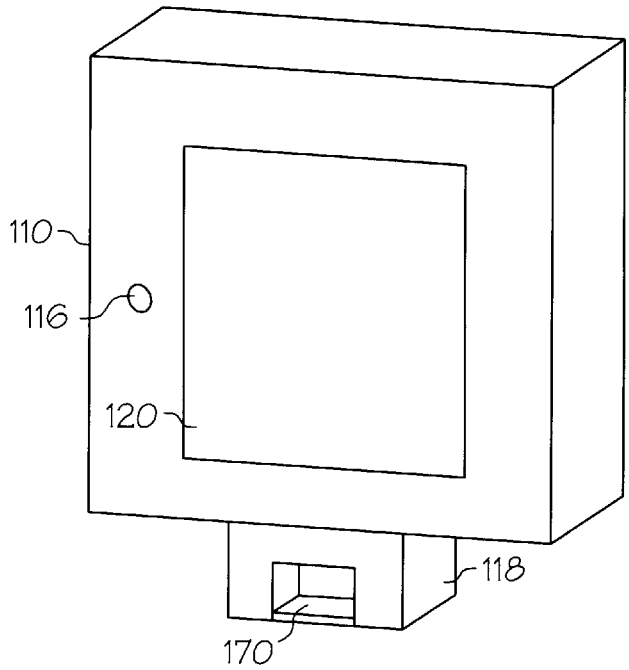
FIG. 5 shows the outer assembly with the control unit.

FIG. 4 shows the catch tray 150. The catch tray 150 is shown square but may be any shape which performs the function or serves the needs of the user. Rotatable plate 140 contains a receiver 146 for receiving the spindle 152. Receiver 146 may be threaded holes, pentagon or hexagon shaped holes, sockets, brackets, or other mechanisms including or not including bearings.

Catch tray 150 includes opening 154. Rotatable plate 140 rotates upon spindle 152 to become positioned such that one of the openings 142 in rotatable plate 140 aligns with opening 154 in the catch tray 150. A desired volume of items may then fall from the storage container 130 through openings 142 and 154.

The Spindle 152 has a cross section which may be circular, hexagonal, pentagonal, or any other shape is adapted for insertion into receiver 146. The mating engagement between spindle 152 and receiver 146 prevents rotation there between. Therefore, engagement of rotation mechanism 155 causes spindle or drive shaft 152 to rotate plate 140 to dispense a desired volume of items.

Cabinet 110 includes a base 112. Base 112 includes a product aperture 114. The alignment of product aperture 114, openings 142 of plate 140, and openings 154 in catch tray 150, permits a desired volume of items to fall from hopper 132 to container 170.

The catch tray 150 preferably rests on the top surface of the base 112 receiving support therefrom. The base 112 also includes a shaft aperture 202 which is sized to receive spindle 152. Spindle 152 is freely rotatable within shaft aperture 202. The catch tray 150 may be secured in a desired location on the top surface of base 112 by brackets, bolts and nuts, screws and/or any other desired affixation mechanism.

Rotation mechanism 155 facilitates the rotation of the rotatable plate 140 on spindle or drive shaft 152. The rotation mechanism 155 is an electric motor which preferably includes spindle or drive shaft 152. (FIG. 8) Engagement of motor 155 rotates spindle 152 thereby in parting rotational motion to plate 140. Spindle 152 extends upwardly for motor 155 through shaft opening 157 in catch tray 150 for insertion into rotatable disk 140. Spindle 152 is positioned on center with respect to rotatable disk 140. Rotation mechanism 155 is positioned within a motor cavity 200 of base 112 of cabinet 110. The motor 155 may be secured within motor cavity 200 by any preferred affixation mechanism including but not necessarily limited to brackets, bolts and nuts, and/or screws. The shaft opening 157 is sized to enable free rotation of spindle 152 there between. Alternatively a manual mechanism, such as a hand crank, may turn the spindle 152. When the spindle 152 turns, it causes plate 140 to rotate about spindle 152. In an alternative embodiment, rotation of wheel 156 may be accomplished by a belt drive, about the spindle 152 or through use of a chain, magnets, or other mechanisms.

FIGS. 5–8 show cabinet 110. In one alternate embodiment, the cabinet 110 contains a control device 160, such as, a rotatable knob 116. The user turns this knob 116 to select the number of items that will fall through the openings 142 and 154. Because the machine is designed to permit one or more items to fall through at a time, the control device 160 controls the number of items counted by controlling how many openings 142 are rotated past openings 154. Thus, if there are five openings 142 in rotatable plate 140 and the user sets the knob 116 to dispense three portions, rotatable plate 140 will rotate more than 180 degrees. One full rotation will dispense five portions. Two rotations will dispense ten portions. Dispensing of items occurs by consecutive alignment of openings 142 and 154 where each alignment permits a desired portion of items to pass therethrough.

The rotation between each opening 142 with respect to opening 154 represents a 72° rotation of plate 140. It is anticipated that a maximum of three to four openings will be rotated at any given time to dispense three to four portions of items into container basket 170 for cooking. The controller 160 counts the number of openings 142 for rotation past openings 154 during the dispensing of a desired volume of items into container basket 170.

In alternative embodiments, control device 160 may include one or a plurality of push buttons representative of a pre-selected number or volume of items corresponding to small, medium, and/or large portions which may then be cooked by an individual. Alternatively, control device 160 may have a plurality of indicator slots or markings for selection of a desired number or volume of items to be dispensed. Any number of push buttons and/or knobs may be utilized to assist in the selection of a desired number or volume of items to be dispensed by the dispensing device 10. Control device 160 may further include a touch pad selection switch which may be used to select a desired number or volume of items to be dispensed. Control device 160 may also include an LED display and/or indicator lights to communicate information to an individual such as the number or volume of selected items and/or the status of the contents of the hopper or the activation of a refrigeration unit. The display and/or LED lighting system may further be electrically coupled to sensors for warning an operator of an undesirable condition and/or malfunction of the dispensing device 10.

Figure 6:
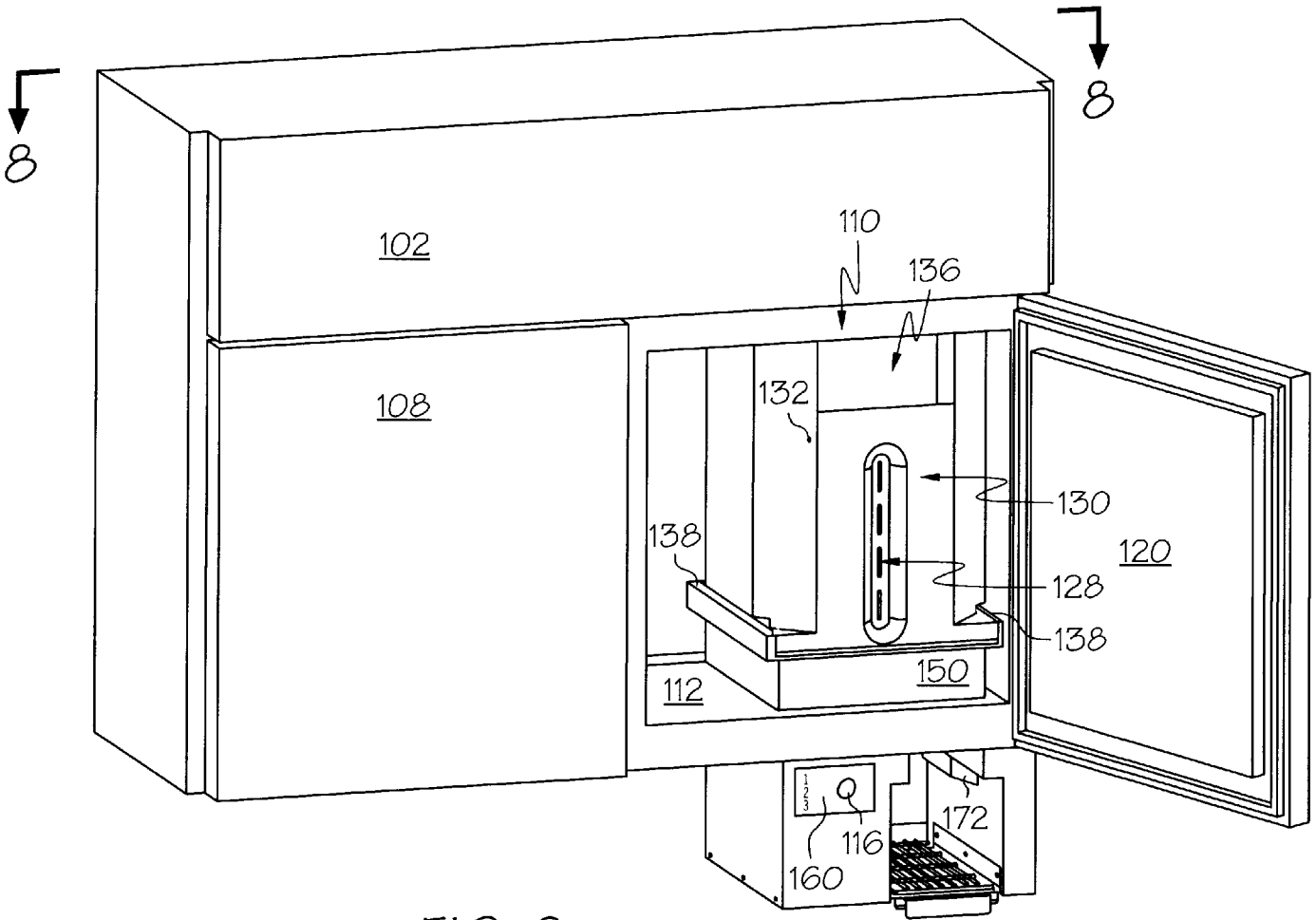
FIG. 6 shows an alternative embodiment of the machine.

Alternatively, as maybe seen in FIG. 6, the storage compartment 130 may include one or more markings 128 which maybe utilized to communicate the volume of items within the hopper 132. Refilling of the hopper is thereby facilitated.

The hopper 132 may be refilled by passing of items to be dispensed through filler slot 136 which traverses the top of the front face of the hopper 132. Alternatively, the hopper 132 may be slidably separated from the catch tray 150 and cabinet 110 through the use of matching channels 138 which are integral to the top sides of the catch tray 150 and to the bottom sides of hopper 132. The hopper 132 may thereby be partially or completely slidably retracted outwardly from the cabinet 110 for refilling. In the event of complete separation, the chute 134 will be required to be blocked for reopening following the insertion into the cabinet 110 and catch tray 150 to prevent spillage of items during refilling. It is anticipated that refilling of the hopper 132 will occur through use of filler slot 136 or partial outward slidable retraction of hopper 132 relative to catch tray 150.

In an alternate embodiment, the openings 142 and 154 may be so designed as to permit more than one item to pass through the openings 142 and 154 at any one time thus altering the number of items per degree of rotation.

The control device 160 may be mechanical, electrical, electromechanical, electronic, or might even be a microprocessor.

In one embodiment, the cabinet 110 is so constructed that it rests upon a stand 118 which has a smaller footprint than the full area of the cabinet 110 thus reducing the required space for the machine.

The container 170 generally receives the items which have been dispensed. This container 170 may be, as shown, a frying basket or it could, in an alternate embodiment, be a bag or other container. The user removes the container 170 to perform whatever function the user wishes to facilitate cooking. The container may be slidably held in position by basket guides 172.

In one embodiment, the cabinet 110 is a refrigeration unit 102 and the items to be dispensed are frozen chicken nuggets. The user fills the storage component 130 with uncooked or precooked, preferably frozen, chicken nuggets. By the force of gravity, the frozen chicken nuggets fall onto the rotatable plate 140. An operator will select a quantity or volume of items to be dispensed by manipulation of control device 160. Control device 160 in turn may activate a motor and/or other drive mechanism to rotate drive shaft 152 as engaged to the center of the rotatable plate 140. Rotatable plate 140 then rotates to align openings 142 to openings 154 through catch tray 150. Alignment of openings 142 to openings 154 permits falling of items into object container 170 which may be a frying basket 170. As described above, the user may select the number of items to be dispensed.

The invention is not limited to dispensing frozen chicken nuggets. The machine may be configured to dispense, for example, dry cell batteries which would be dispensed into a box or bag. Because dry cell batteries do not require refrigeration or sanitation, the cabinet could be a simple open frame. The machine may also dispense hard candies into a bag. Hard candies do not require refrigeration but they must be kept sanitary. In this embodiment, the cabinet would be closed but would not be refrigerated.

In another embodiment in which the machine may dispense items such as dry-cell batteries, the chute 134 may be a cylinder with a diameter only slightly larger than the diameter of a dry-cell battery. As the batteries fall into and through the chute 134, the dry-cell batteries become aligned substantially vertically. Then, if the rotatable plate 140 is made slightly thicker than the length of the dry-cell batteries, the dispenser can dispense dry-cell batteries at a desired rate.

Figure 7:
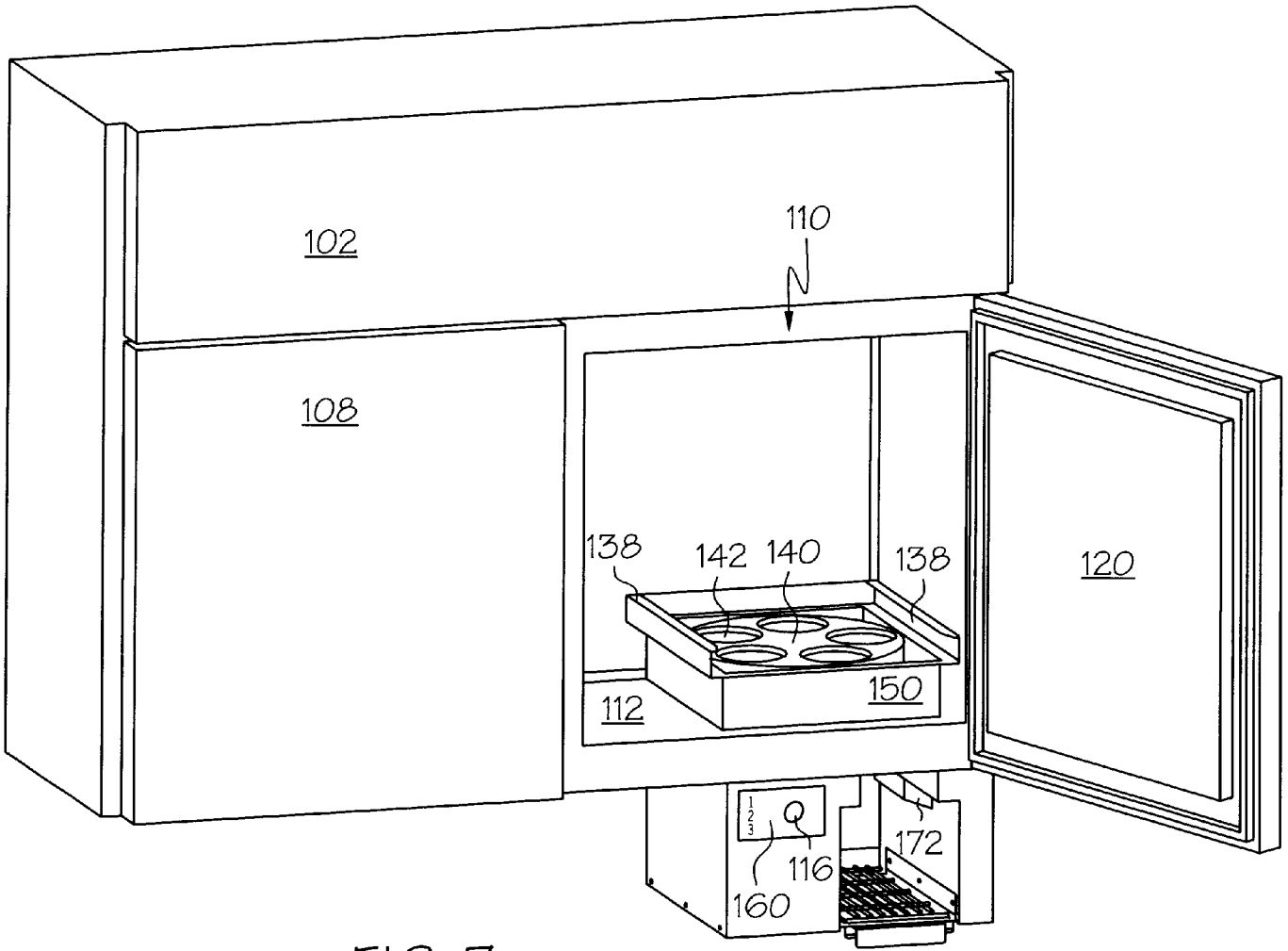
FIG. 7 show the embodiment of FIG. 6 without the hopper.

FIGS. 6 and 7 show a dispensing machine having side by side cabinets 110. The second cabinet 108 may be used as an additional refrigeration unit for storage of items. Alternatively, second cabinet 108 may include an additional dispensing machine having the features and functions of the embodiments described above. Any number of dispensing machines may be positioned side by side as desired.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

I claim as follows:

1. A dispensing machine for dispensing items said dispensing machine comprising:

a storage compartment holding said items;

a rotatable plate below the storage compartment, said rotatable plate containing at least one opening, said opening being constructed and arranged to permit at least one of said items to fall through the at least one opening, said opening arranged to contain a predetermined portion of items to be dispensed;

a catch tray located substantially contiguous to and below said rotatable plate, said catch tray containing at least one aperture, said at least one aperture being constructed and arranged to permit said predetermined portion of items to fall through the at least one aperture upon alignment of said at least one opening and said at least one aperture;

an object container below the catch tray and said at least one aperture, said object container constructed and arranged for collecting said items; and a frame for containing the storage compartment, the rotatable plate, the catch tray, and the object container.

2. The dispensing machine of claim 1, wherein the frame is a cabinet.

3. The dispensing machine of claim 2, wherein the cabinet is a refrigeration unit.

4. The dispensing machine of claim 1, said frame further comprising at least one door.

5. A dispensing machine for dispensing items, said dispensing machine comprising:

a storage compartment holding said items;

a rotatable plate below the storage compartment, said rotatable plate containing at least one opening, said opening being constructed and arranged to permit at least one of said items to fall through the at least one opening;

a catch tray located substantially contiguous to and below said rotatable plate, said catch tray containing at least one aperture, said at least one aperture being constructed and arranged to permit at least one of said items to fall through the at least one aperture upon alignment of said at least one opening and said at least one aperture;

an object container below the catch tray and said at least one aperture, said object container constructed and arranged for collecting said items; and a frame for container the storage compartment the rotatable plate, the catch tray, and the object container, said frame further comprising at least one door;

said frame comprising horizontal sides, said at least one door being hingably connected to one of the horizontal sides, said at least one door covering a correlative opening in said one of the horizontal sides.

6. The dispensing machine of claim 5, said at least one door being a removable hatch fastened by removable fasteners, said batch covering a correlative opening in said one of the horizontal sides.

7. The dispensing machine of claim 1, wherein the items are edible items.

8. The dispensing machine of claim 7, wherein the edible items are chicken nuggets.

9. The dispensing machine of claim 1, further comprising a rotation apparatus engaged to said rotatable plate.

10. The dispensing machine of claim 9, said rotation apparatus comprising a motor.

11. The dispensing machine of claim 9, wherein the rotation apparatus is operated manually.

12. The dispensing machine of claim 1, further comprising a control apparatus.

13. The dispensing machine of claim 12, wherein the control apparatus is constructed arranged to control the number of items which pass through the rotatable plate and catch fray into the object container.

14. The dispensing machine of claim 12, wherein the control apparatus is electro-mechanical.

15. The dispensing machine of claim 12, wherein the control apparatus is electronic.

16. The dispensing machine of claim 12, said control apparatus comprising a microprocessor.

17. The dispensing machine of claim 12, wherein the control apparatus is constructed and arranged to terminate rotation of the rotation apparatus following the passage of a pre-selected number of items into the object container.

18. The dispensing machine of claim 1, said storage compartment comprising a hopper holding the items, and a chute through which the items pass onto the rotatable plate.

19. The dispensing machine of claim 1, wherein the object container is a deep-frying basket.

20. The dispensing machine of claim 1, wherein the object container is a bag.

21. The dispensing machine of claim 1, wherein the items are inedible items.

* * * * *